US006341785B1

(12) United States Patent
Benoit

(10) Patent No.: US 6,341,785 B1
(45) **Date of Patent: *Jan. 29, 2002**

(54) REINFORCED FRAME FOR A ROLLER SKATE

(75) Inventor: Louis Benoit, La Balme de Sillingy (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/147,021

(22) PCT Filed: Mar. 12, 1997

(86) PCT No.: PCT/FR97/00440

§ 371 Date: Sep. 11, 1998

§ 102(e) Date: Sep. 11, 1998

(87) PCT Pub. No.: WO97/33665

PCT Pub. Date: Sep. 18, 1997

(30) Foreign Application Priority Data

Mar. 14, 1996 (FR) ..... 96 03364

(51) Int. Cl.[7] ..... A63C 17/02

(52) U.S. Cl. ..... 280/11.221; 280/7.13; 280/11.223; 280/11.2 C; 280/11.27; 280/11.28

(58) Field of Search ..... 280/11.22, 11.2, 280/7.13, 11.27, 11.221, 11.28, 11.223, 11.26

(56) References Cited

U.S. PATENT DOCUMENTS

| | | | | | |
|---|---|---|---|---|---|
| 1,960,234 | A | * | 5/1934 | Eckels | 280/11.22 |
| 2,254,450 | A | * | 9/1941 | Ronish | 280/11.2 |
| 3,086,787 | A | | 4/1963 | Wyche | |
| 3,756,614 | A | | 9/1973 | Grubin | |
| 5,092,614 | A | * | 3/1992 | Malewicz | 280/11.22 |
| 5,330,208 | A | * | 7/1994 | Charron et al. | 280/11.22 |
| 5,332,242 | A | | 7/1994 | Cann et al. | 280/11.18 |
| 5,388,846 | A | | 2/1995 | Gierveld | |
| 5,413,380 | A | * | 5/1995 | Fernandez | 280/11.19 |
| 5,474,310 | A | * | 12/1995 | Chen | 280/11.22 |
| 5,484,148 | A | | 1/1996 | Olivieri | 280/11.18 |
| 5,533,740 | A | * | 7/1996 | Lin | 280/11.22 |
| 5,560,625 | A | * | 10/1996 | Kuykendall | 280/11.22 |
| 5,580,070 | A | * | 12/1996 | Bekessy | 280/11.22 X |
| 5,651,556 | A | * | 7/1997 | Mitchell | 280/11.22 |
| 5,720,488 | A | * | 2/1998 | Foffano et al. | 280/11.22 |
| 5,765,841 | A | * | 6/1998 | Johnson et al. | 280/11.22 |
| 5,772,220 | A | * | 6/1998 | Gaster | 280/11.22 |
| 5,799,955 | A | * | 9/1998 | Iverson | 280/11.22 |
| 5,803,466 | A | * | 9/1998 | Wrike | 280/7.13 |
| 5,803,469 | A | * | 9/1998 | Yoham | 280/11.22 X |
| 5,915,703 | A | * | 6/1999 | Wrike | 280/11.22 |
| 5,934,693 | A | * | 8/1999 | Nicoletti | 280/11.22 |
| 6,019,377 | A | * | 2/2000 | Chiu et al. | 280/11.22 X |
| 6,042,124 | A | * | 3/2000 | Cheatman et al. | 280/11.22 |
| 6,045,143 | A | * | 4/2000 | Wrike | 280/11.22 |
| 6,047,972 | A | * | 4/2000 | Rudolph | 280/11.19 |

FOREIGN PATENT DOCUMENTS

| | | |
|---|---|---|
| DE | 1033569 | 7/1958 |
| FR | 2679781 | 2/1993 |

* cited by examiner

*Primary Examiner*—Lanna Mai
*Assistant Examiner*—Toan C To
(74) *Attorney, Agent, or Firm*—Greenblum & Bernstein, P.L.C.

(57) ABSTRACT

A frame for skates and the like with a structure comprising at least one bearing surface (3, 4) engageable by a boot or the like, and a side flange (2) comprising means for attaching one or more ground-engaging members. The components (3, 4–2, 8) of the structure are made of at least two at least partially mutually assembled materials having different mechanical properties.

39 Claims, 3 Drawing Sheets

REINFORCED FRAME FOR A ROLLER SKATE

BACKGROUND OF THE INVENTION

1. Field of the Invention

The present application relates to a frame for gliding sport articles such as roller skates, ice skates.

2. Description of Background and Relevant Information

The frames of the aforementioned type are adapted for the linkage between one or more gliding members themselves (namely the ice skate blade, wheels or rollers) and the user's feet between which it is inserted.

The frames are therefore generally constituted by a bearing surface capable of receiving the athlete's shoe, and by one or two longitudinal lateral flanges adapted to receive the wheels, rollers or the skate blade.

They must also have substantial mechanical resistance characteristics while being as light as possible in order not to require too substantial efforts from the athlete.

Furthermore, the advanced technology in these gliding sport articles, especially in the case of in-line roller skates, further increases the requirements, which must be met by the skate frames, and which must reach a compromise between:

- an increased mechanical resistance and stability, especially for the speed skates, but also for the so-called "free ride", "free style" or "hockey" skates, in order to offer efficiency and an unquestionable response in the transmission of movements to the skate by the skater;
- a certain flexibility, especially in certain zones of the skate to allow for an adaptation of the shape of the skate to the path taken, especially on curves at high speeds, but also the dampening of shocks and vibrations,
- as light a weight as possible.

Currently known techniques for making frames do not allow meeting all these requirements while maintaining a reasonable manufacturing cost.

Indeed, the oldest manufacturing technique consists of making such frames from sheet metal insert, in a U-shape, as shown in the German patent DE 10 33 569, for example.

Such a construction method, although inexpensive, does not, however, allow obtaining frames with great mechanical resistance except by substantially increasing the thickness of the sheet metal and therefore its weight, and it allows obtaining a certain flexibility in selected areas even less.

Another commonly used technique consists of making the frames entirely by molding from synthetic or even metallic materials. The integral molding offers the advantage of allowing sufficiently varied forms, but furthermore presents numerous disadvantages, the main disadvantage being the impossibility of the compromise sought and cited previously, for even if the constitutive material of the frame has characteristics of stiffness, it cannot offer at the same time characteristics of flexibility, except by providing zones that are more or less thick according to their function, but this would lead to molds having a burdensome design because it is complicated.

In this field, frames made from composite fibers are also known. Such frames can actually be made in almost any shape possible, but their construction is extremely expensive and hard to industrialize. Moreover, such frames are certainly very stiff but lack flexibility and are therefore fragile and uncomfortable.

Finally, U.S. Pat. No. 5,388,846 proposed making a frame for an ice skate or a roller skate from a sectioned metallic bar whose transverse section corresponds to the general section desired for the frame, the final shape of the frame being obtained after machining with removal of material.

Such a construction method is again very expensive, given the machining time necessary and the quantity of material that must be removed. In addition, it does not allow great freedom with respect to the shape or profile of the frame, nor in seeking the mentioned compromise.

U.S. Pat. No. 3,086,787 to C. A. Wyche relates to a roller skate with an adjustable length whose stability and stiffness are ensured regardless of the number of rollers and the distance separating the front and rear rollers. The skate comprises a support plate bent in an inverted U-shape, preferably made of fairly thin steel on which elements are slidably mounted for main g the heel and tip of the foot. To each of the side portions of the support plate, there is welded or screwed a downwardly extending metal plate, preferably made of hardened steel and extending the full length of the skate.

SUMMARY OF THE INVENTION

The object of the present invention is to overcome the aforementioned drawbacks and to provide an improved frame for gliding sport articles which allow resolving the various problems previously mentioned and, in particular, combining the characteristics of mechanical resistance, adaptability, construction flexibility, lightness and low manufacturing costs.

The object is achieved with the frame according to the invention, which comprises at least one bearing surface adapted to receive a shoe and two lateral flanges provided with means for attaching at least one gliding member, wherein at least one of the lateral flanges is formed, at least partially, of a reinforcement made of a different material and having different mechanical properties with respect to the rest of the frame.

BRIEF DESCRIPTION OF THE DRAWINGS

In any case, the invention will be better understood and other characteristics thereof will be shown with the following description; with reference to the attached schematic drawings representing, by way of non-limiting examples, several frame embodiments, and in which.

DETAILED DESCRIPTION OF THE INVENTION

Figure 1:
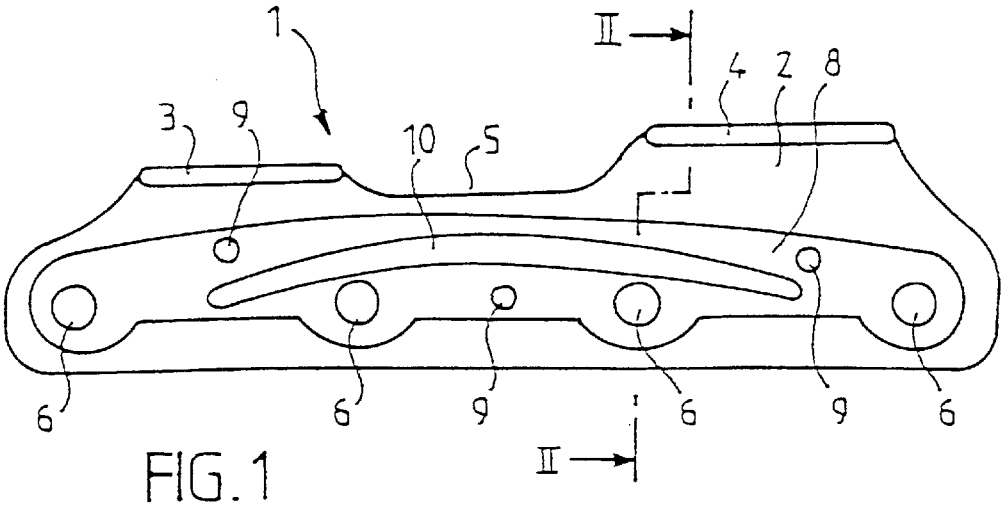
FIG. 1 is a side view of a frame according to a first embodiment.
Figure 2:
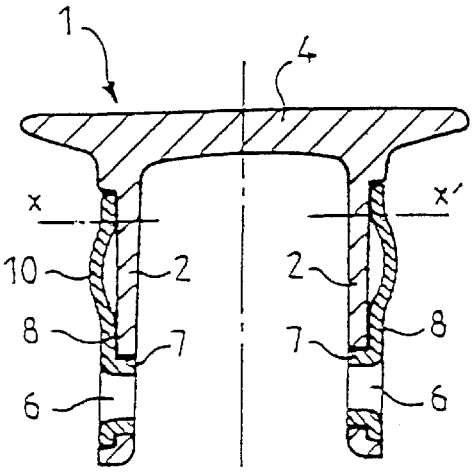
FIG. 2 is a cross-sectional view along the line II—II of FIG. 1.

As shown in FIGS. 1 and 2, the frame 1 according to the invention is made at least in part of plastic and is generally presented in the form of two longitudinally extending and transversely spaced apart lateral flanges 2 connected together by two platforms 3 and 4, or foot-bearing portions of the frame, which give the assembly a substantially U-shaped transverse section.

Each of these platforms, or bearing portion 3 and 4 constitutes a bearing surface capable of receiving the athlete's shoe, the latter (not shown) being attached by any known means, especially glue, rivets, screws, etc., but it can also be attached in a removable manner by non-permanent connecting means.

It is also noted that the platforms 3 and 4 are distinct and separated from each other by a cutout 5, and are positioned at different levels of height, the platform 4 being higher than the platform 3, to take into account the natural position of the athlete, the heel being slightly elevated. Of course, they could also be positioned at the same level.

Each flange 2 has a straight elongated form, but it can also be slightly bent in an arc of a circle in the longitudinal direction.

At the lower end of each flange, holes 6 are provided for attaching rollers, or depending on the case, a skate blade.

Each hole 6 is made in a cylindrical boss 7 capable of being obtained by die casting, boring, etc. The holes 6 positioned correspondingly in the two flanges 2 are coaxial.

According to the invention, the constituent parts of the previously mentioned structure constituting the frame 1, namely the bearing portions 3 and 4 and the flanges 2, are made from at least two materials of different mechanical characteristics, at least partially attached onto or into one another.

In this case, but in a non-limiting way, it is the flanges 2 which, at least in part, are made of a material different from the rest of the structure.

Indeed, the invention can relate to other parts of the frame as this will be described later.

In the example of FIGS. 1 and 2, the lateral flanges 2 are parallel with respect to one another to form a "U" with the bearing portions 3 and 4 and are made of the same material as the bearing portions, but they are doubled by external reinforcements 8 made of a different material capable of modifying the mechanical characteristics of the assembly thus obtained.

For example, the reinforcements 8 are metallic, whereas the rest of the structure is obtained by molding a plastic material, but it can very well be imagined that the reinforcements 8 be obtained from a plastic material with predetermined mechanical characteristics, whereas the rest of the structure is also made from a plastic material with different characteristics.

Still according to the example of FIGS. 1 and 2, the two flanges 2 are symmetrical, each being integrally made of plastic and integrally doubled with an attached external metallic reinforcement 8. As can be seen in each of FIGS. 1 and 2, the reinforcements 8, 8 and 8A, 8A', respectively, are positioned in recesses beneath the foot-bearing portions of the frame 1.

These metallic reinforcements 8 are obtained by cutting and stamping, then attached to flanges 2 by any mechanical means such as rivets 9, along a transverse direction XX', or even by screwing, glueing, welding, etc.

It can also be envisioned that the metallic reinforcements 8 be attached to the flanges 2 by molding when the latter are molded.

Herein, the term flange, when reinforced with a reinforcement, should be understood to refer to a base part of the flange, since the reinforcement is described as being part of such flange. Therefore, and with regard to FIGS. 2–5, further described below, for example, each of the following parts could be characterized as a "base part of a flange": parts 2, 2 in FIG. 2; parts 2A, 2A in FIG. 3; parts 2B, 2B in FIG. 4; and part 2C in FIG. 5. Part 2C' in FIG. 5 could be characterized as a "flange", because it is not reinforced.

Such reinforcements 8 also have the advantage of comprising, at their lower ends, the bored and threaded boss 7, to allow attaching, without any intermediate piece, of the gliding members on a stiff metallic zone, or further on hard plastic where the reinforcements 8 would be made of a loaded plastic rather than a flexible plastic constituting the rest of the structure.

Advantageously, the metallic reinforcements 8 comprise, in their longitudinal direction, stiffening ribs 10 obtained by stamping, extending substantially along the whole length of the flange 2, and having a generally bent shape.

Such a characteristic allows, at equal stiffness, dividing the thickness and therefore the weight of the reinforcement 8 practically in half.

Figure 3:
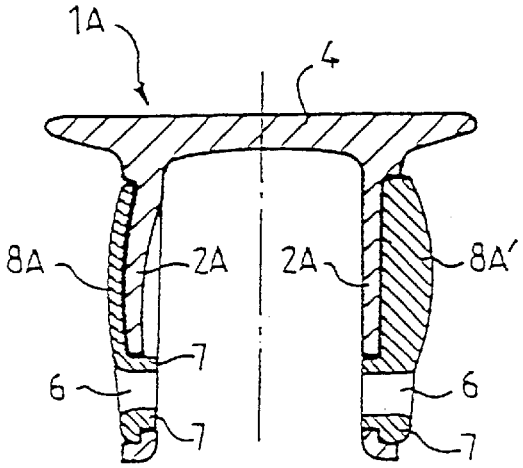
FIG. 3 is a cross-sectional view of a frame similar to FIG. 2 according to a second embodiment.

The embodiment example of FIG. 3 differs essentially from the preceding one in that the two flanges 2A are substantially symmetrical and integrally made of plastic, one of them being integrally doubled with a metallic reinforcement 8A, whereas the other is doubled with a different plastic reinforcement 8A', both of these being attached to the associated flange 2A and defining the attaching holes 6.

In this case, the metallic reinforcement 8A does not comprise stiffening ribs but is substantially bent. The plastic reinforcement 8A' bulges according to a thickness predetermined depending on the characteristics to be obtained. The frame 1A resulting therefrom has asymmetrical qualities.

Figure 4:
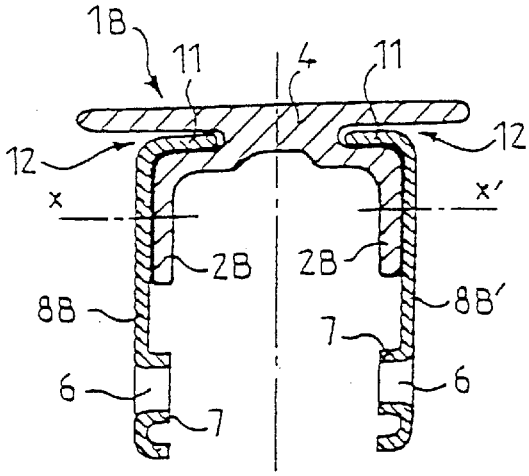
FIG. 4 is a cross-sectional view of a frame similar to FIG. 2 according to a third embodiment.

According to the embodiment of FIG. 4, the two flanges 2B are symmetrical and are constituted almost integrally with metallic reinforcements 8B, 8B' covering the plastic base of which the flanges 2B are on made which they are attached on the outside, and the two flanges 2B being made in one piece i.e., unitary, by molding with the bearing portions 3, 4.

Figure 5:
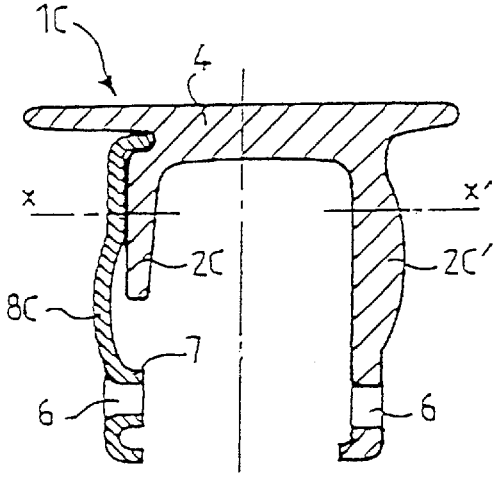
FIG. 5 is a view of a frame similar to FIG. 2 according to a fourth embodiment.
Figure 9:
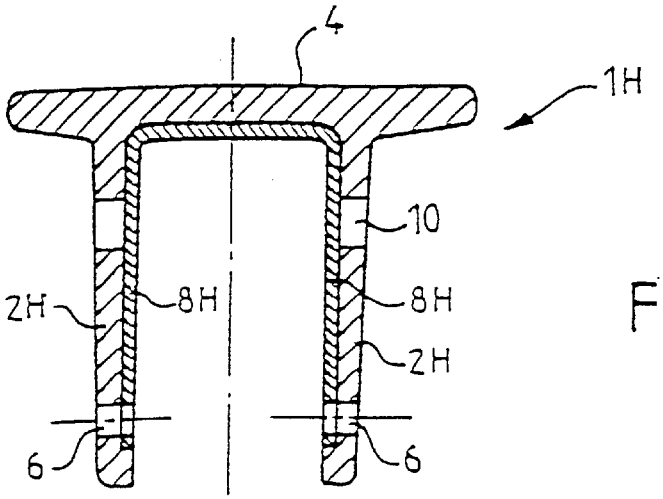

It is noted that in this case, the reinforcements 8B and 8B' are attached to the rest of the molded plastic structure due to upper returns 11 obtained by an inwardly directed perpendicular bends and capable of being housed in laterally extending recesses 12 provided under the upper surface of the bearing portion 4. The positive attachment is made as previously described by rivets 9 along a transverse direction XX'. Although not specifically labelled, laterally extending recesses are provided for the reinforcements of FIGS. 2, 3, 5, and 9 (FIGS. 5 and 9 being further described below). For example, in FIG. 2, laterally extending recesses are provided on outer surfaces of the base parts of the flanges to house the reinforcements 8, in which the top edges of the reinforcements are shown to abut the upper extents of the recesses. In FIG. 9, the laterally extending recesses are on the inner surfaces of the base parts of the flanges.

Additionally in this case, the bored and threaded bosses 7 are made only in the reinforcements 8B, 8B', since the base parts 2B on which they are fixed double them only partially.

According to the embodiment example of FIG. 5, the frame 1C comprises, on the one hand, a plastic flange 2C' obtained in one piece by molding with the bearing portions 3, 4, and, on the other hand, a flange constituted by an integral metallic reinforcement 8C covering a plastic base part 2C on which it is externally attached and which is also obtained in one piece by molding with the bearing portions 3, 4.

Additionally in this case, concerning the reinforced side of the frame, the bored and threaded boss 7 is made directly in the reinforcement 8C as previously described.

Thus, regardless of the selected example, an improvement of the torsional and flexional stiffness of the frame is obtained due to the reinforcement elements. Of course, these can be arranged between the inside and outside of the frame so as to optimize the necessary mechanical characteristics thereof. As already mentioned in the example of FIG. 5, it is possible to have a reinforcement on one side only of the frame, since it is known that the maximum of the forces transmitted by the skater to the wheels pass through the inside skirt or flange of the frame. That is also why certain examples envision using different materials between the internal flange and the external flange.

In the embodiment examples of FIGS. 6–10, the frame 1E, 1F, 1G, 1H is generally constituted by bearing portions 3, 4, and two lateral flanges 2E, 2F, 2G, 2H, parallel with respect to one another and forming a "U" with the bearing portions, this structure being obtained by molding a plastic material around at least one reinforcement 8E, 8F, 8G, 8H, made of metal or a plastic material different from the first, arranged inside the flanges. Thus, although it can be said that the reinforcements are housed in respective recesses of the flanges, such recesses, or cavities, are not pre-formed.

Figure 6:
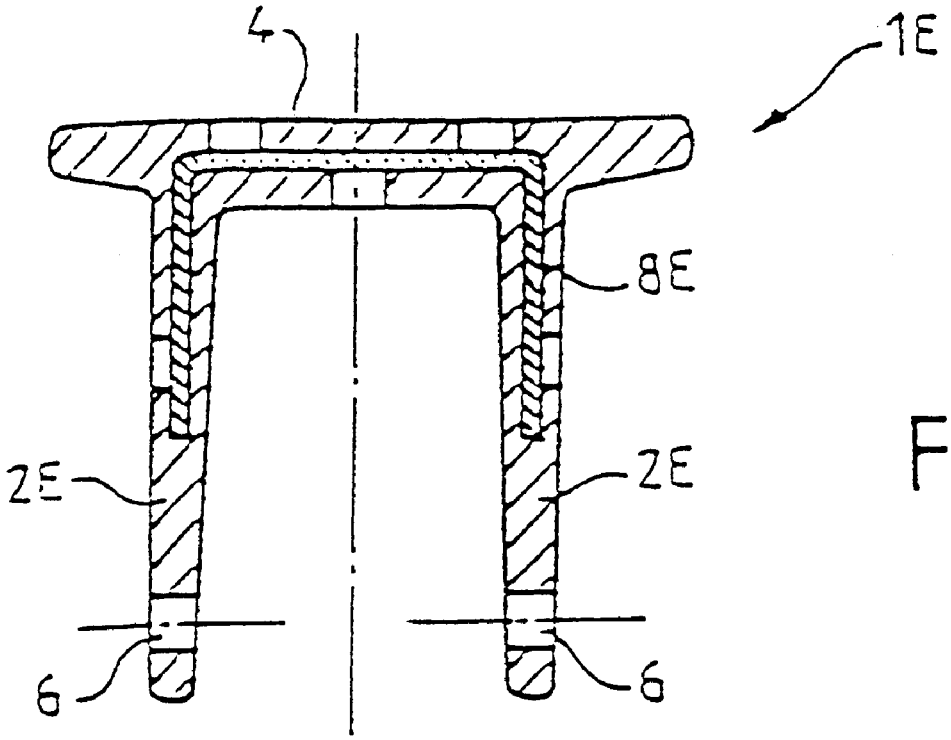
FIGS. 6–9 are cross-sectional views similar to FIG. 2 of other embodiments of a frame obtained by molding.

More particularly, according to FIG. 6, the reinforcement 8E forms a "U" extending, on the one hand, inside the bearing portion 4, and, on the other hand, inside the lateral flanges 2E by their parallel arms, the end of the latter being positioned above the end parts of the flanges 2E which are bored with holes 6 and threaded to ensure the attachment of the gliding members.

Figure 7:
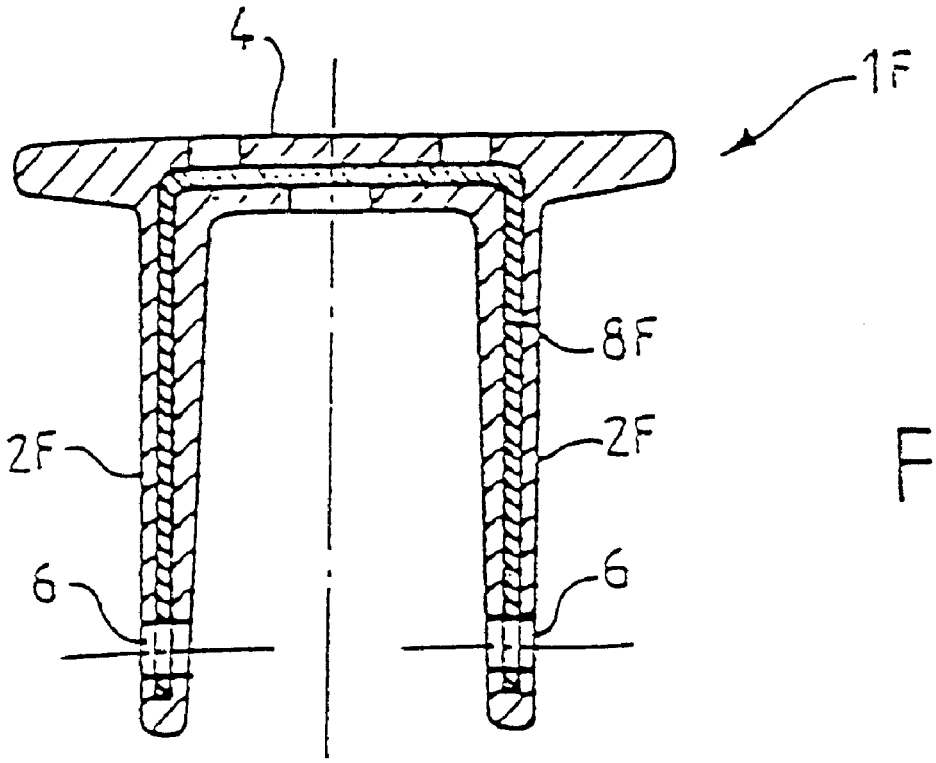

However, according to the alternative embodiment shown in FIG. 7, the reinforcement 8F forms a "U" extending, on the one hand, inside the bearing portion 4, and, on the other hand, inside the lateral flanges 2F by their parallel arms, the end of the latter extending proximate the end parts of the flanges 2F which are bored with holes 6 and threaded to ensure the attachment of the gliding members. This last solution offers the advantage of creating reinforcements at the level of the holes 6.

Figure 8:
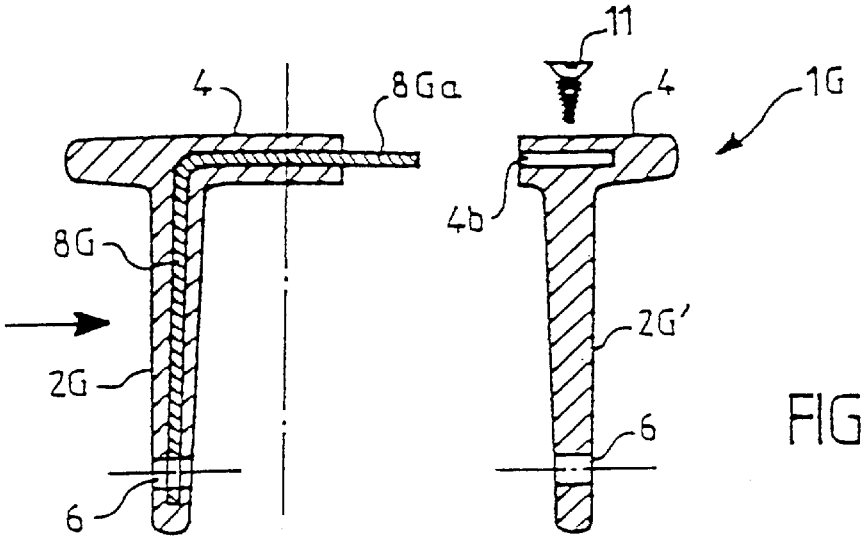

According to the example of FIG. 8, the frame 1G is constituted of two parts, the first part integrating a reinforcement 8G molded in a portion of the bearing portion 4 and a flange 2G, generally perpendicular to the portion of the bearing portion 4, the second part comprising a complementary portion of the bearing portion 4 and a second flange 2G' with no reinforcement, means for connecting the two parts 2G, 2G' of the frame 1G being arranged at the level of the bearing portion 4.

The means for connecting these two frame parts are constituted by an extension 8Ga of the reinforcement 8G of the first frame part extending beyond its part of the bearing surface 4 so as to exit freely therefrom in order to cooperate with a corresponding housing 4*b* provided in the other portion of the bearing portion 4 of the second part of the frame 1G.

The immobilization of the reinforcement part 8Ga in the housing 4*b* is done by any means, in this case by a screw 11. The advantage of such an embodiment is that the frame can be made more simply in two parts and that the assembly of these two parts can easily be obtained by inserting one of the parts.

In the frame 1H, according to the example of FIG. 9, the reinforcement 8H forms a "U" extending in an apparent way on the internal surfaces of the "U" formed by the parallel arms of the flanges 2H, and by the bearing plane 4 connecting them.

Figure 10:
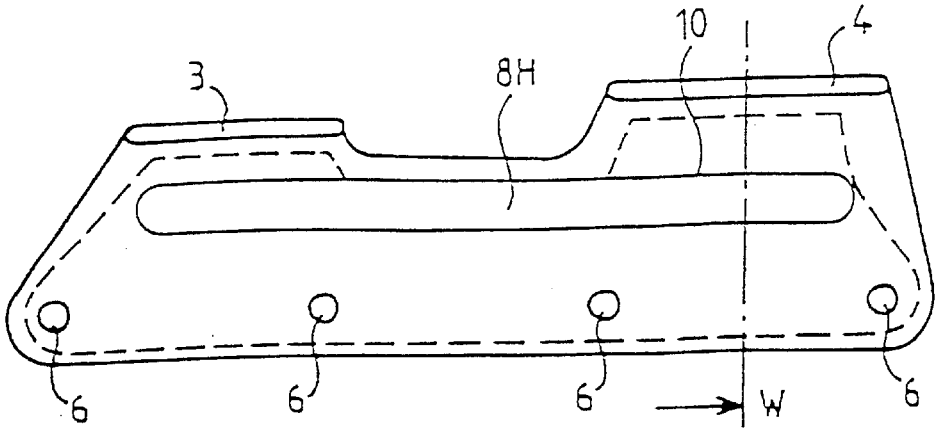
FIG. 10 is a side view of a frame obtained according to the embodiment of FIG. 9.

According to this same example, at least one of the lateral flanges 2H comprises a longitudinal window 10 for visualizing the reinforcement 8H, as shown in FIG. 10.

It is noted that the reinforcements can also be made of composite materials (glass fibers, carbon fibers, etc.).

What is claimed is:

1. A frame for a gliding sport article, said frame comprising:

a front foot-bearing portion and a rear foot-bearing portion, said front and rear foot-bearing portions being made unitarily;

transversely spaced apart lateral flanges extending downwardly from each of said front and rear foot-bearing portions, each of said lateral flanges comprising at least a base part and at least one of said lateral flanges further comprising a reinforcement, at least said one of said lateral flanges further comprising a recess with at least a part of said reinforcement being fastened within said recess; and said reinforcement being made of a material having different mechanical characteristics relative to said base parts of said lateral flanges, said reinforcement extending longitudinally vertically beneath both of said front and rear foot-bearing portions.

2. A frame according to claim 1, wherein:

said reinforcement extends downwardly adjacent said one of said lateral flanges and includes an upper end not extending outwardly from said base part.

3. A frame according to claim 1, wherein:

said reinforcement reinforces only said base part of at least one of said lateral flanges, said reinforcement not reinforcing either of said front and rear foot-bearing portions.

4. A frame according to claim 1, wherein:

said front and rear foot-bearing portions and said base parts of said lateral flanges are made of an identical material; and said reinforcement is made of a material different from said identical material.

5. A frame according to claim 1, wherein:

said front and rear foot-bearing portions and said base parts of said lateral flanges are made of plastic; and said reinforcement is made of a metallic material.

6. A frame according to claim 1, wherein:

said front and rear foot-bearing portions and said base parts are made of a first plastic material; and said reinforcement is made of a second plastic material, said first and second plastic materials having different mechanical characteristics.

7. A frame according to claim 1, wherein:

said lateral flanges extending downwardly from each of said front and rear foot-bearing portions are parallel and, in transverse cross section, said lateral flanges and foot-bearing portions form a U-shape, formed by molding a plastic material; and said reinforcement comprises an external metallic reinforcement doubling said base part of said one of said lateral flanges.

8. A frame according to claim 7, wherein:

said lateral flanges are symmetrical, whereby each of said lateral flanges comprises unitary plastic base parts and external metallic reinforcements doubling respective ones of said base parts, with each of said reinforcements being fastened in a recess of a respective one of said lateral flanges.

9. A frame according to claims 7, wherein:

said lateral flanges are substantially symmetrical, whereby each of said base parts of said lateral flanges is made of plastic, said reinforcement being made of metal and doubling one of said base parts, said frame further comprising a second reinforcement made of plastic, said plastic reinforcement doubling a second of said base parts.

10. A frame according to claim 7, wherein:

said lateral flanges are symmetrical, whereby each of said lateral flanges comprises unitary plastic base parts and external metallic reinforcements doubling respective ones of said base parts, with each of said reinforcements being fastened in a recess of a respective one of said lateral flanges.

11. A frame according to claim 7, wherein:

a said base part of a first of said lateral flanges is formed of plastic and is unitary with at least a first of said front and rear bearing portions, said reinforcement comprising a metallic reinforcement molded on an external side of said first of said front and rear bearing portions; and a said base part of a second of said lateral flanges is formed of plastic and is unitary with at least a second of said front and rear bearing portions, said first and second lateral flanges being transversely spaced apart, said second of said lateral flanges not including a said reinforcement.

12. A frame according to claim 1, wherein:

a mechanical means fastens said reinforcement to said one of said lateral flanges.

13. A frame according to claim 12, wherein:

said mechanical means comprises rivets, glue, screws, or a weld.

14. A frame according to claim 1, wherein:

said reinforcement is metallic and is made by cutting and stamping.

15. A frame according to claim 1, wherein:

said reinforcement extends downwardly to a lower end, said lower end including a bored and threaded boss to attach gliding members.

16. A frame according to claim 1, wherein:

said reinforcement comprises at least one stiffening rib.

17. A frame according to claim 1, wherein:

said lateral flanges extending downwardly from each of said front and rear foot-bearing portions are parallel and, in transverse cross section, said lateral flanges and foot-bearing portions form a U-shape, by molding a plastic material; and said reinforcement comprises an internal reinforcement molded at least partly within said recess in said at least one of said lateral flanges.

18. A frame according to claim 17, wherein:

said reinforcement is metallic.

19. A frame according to claim 17, wherein:

said reinforcement comprises a U-shape extending within at least one of said front and rear foot-bearing portions and within said base parts of each of said lateral flanges, said reinforcement having lower ends above lower ends of said base parts, each of said lower ends of said base parts of each of said lateral flanges having threaded holes for attachment of gliding members.

20. A frame according to claim 17, wherein:

said reinforcement comprises a U-shape extending within at least one of said front and rear foot-bearing portions and within said base parts of each of said lateral flanges, said reinforcement having lower ends proximate lower ends of said base parts, each of said lower ends of said reinforcement and said lower ends of said base parts having threaded holes for attachment of gliding members.

21. A frame according to claim 17, wherein:

said frame comprises first and second laterally distinct parts, said first distinct part integrating said reinforcement molded in a first portion of at least one of said front and rear foot-bearing portions and in one of said lateral flanges;

said second distinct part comprises a second portion of at least a second of said front and rear foot-bearing portions, said second distinct part having no said reinforcement; and said first and second distinct parts are connected at said first and second portions of said front and rear foot-bearing portions.

22. A frame according to claim 21, wherein:

said first and second distinct parts are connected at said first and second portions of said front and rear foot-bearing portions by means of an extension of said reinforcement extending beyond said first portion of said at least one of said front and rear foot-bearing portions and a complementary housing positioned in said second portion of said at least one of said front and rear foot-bearing portions, said extension of said reinforcement being positioned within said housing.

23. A frame according to claim 1, wherein:

said lateral flanges extending downwardly from each of said front and rear foot-bearing portions are parallel and, in transverse cross section, said lateral flanges and foot-bearing portions form a U-shape, by molding a plastic material;

said recess extends along inside surfaces of both of said lateral flanges and at least one of said front and rear foot-bearing portions; and said reinforcement is U-shaped and extends along said inside surfaces within said recess.

24. A frame according to claims 23, wherein:

at least one of said lateral flanges includes a longitudinally extending window for exposing a part of said reinforcement.

25. An in-line roller skate frame comprising:

a front foot-bearing portion and a rear foot-bearing portion, said front and rear foot-bearing portions being made unitarily;

lateral flanges spaced apart a distance to accommodate attachment of a plurality of in-line rollers, said lateral flanges extending downwardly from said front and rear foot-bearing portions, each of said lateral flanges comprising at least a base part depending downwardly from said front and rear foot-bearing portions and at least one of said lateral flanges further comprising a reinforcement, at least said one of said lateral flanges further comprising a laterally extending recess within said base part with at least a part of said reinforcement being fastened within said recess;

said reinforcement being made of a material having different mechanical characteristics relative to said base parts of said lateral flanges, said reinforcement extending downwardly to a lower end; and holes extending within said flanges for attachment of rollers, said lower end of said reinforcement including at least one of said holes.

26. An in-line roller skate frame according to claim 25, wherein:

said reinforcement extends downwardly adjacent said one of said lateral flanges and includes an upper end not extending outwardly from said base part.

27. An in-line roller skate frame according to claim 15, wherein:

said reinforcement reinforces only said base part of at least one of said lateral flanges, said reinforcement not reinforcing either of said front and rear foot-bearing portions.

28. An in-line roller skate frame according to claim 25, wherein:

said front and rear foot-bearing portions and said base parts of said lateral flanges are made of an identical material; and said reinforcement is made of a material different from said identical material.

29. An in-line roller skate frame according to claim 25, wherein:

said front and rear foot-bearing portions and said base parts of said lateral flanges are made of plastic; and said reinforcement is made of a metallic material.

30. An in-line roller skate frame according to claim 25, wherein:

said front and rear foot-bearing portions and said base parts are made of a first plastic material; and said reinforcement is made of a second plastic material, said first and second plastic materials having different mechanical characteristics.

31. An in-line roller skate frame according to claim 25, wherein:

said lateral flanges extending downwardly from each of said front and rear foot-bearing portions are parallel and, in transverse cross section, said lateral flanges and foot-bearing portions form a U-shape, formed by molding a plastic material; and said reinforcement comprises an external metallic reinforcement doubling said base part of said one of said lateral flanges.

32. An in-line roller skate frame according to claim 31, wherein:

said lateral flanges are symmetrical, whereby each of said lateral flanges comprises unitary plastic base parts and external metallic reinforcements doubling respective ones of said base parts, with each of said reinforcements being fastened in a recess of a respective one of said lateral flanges.

33. An in-line roller skate frame according to claim 25, wherein:

a mechanical means fastens said reinforcement to said one of said lateral flanges.

34. An in-line roller skate frame according to claim 33, wherein:

said mechanical means comprises rivets, glue, screws, or a weld.

35. An in-line roller skate frame according to claim 25, wherein:

said reinforcement is metallic and is made by cutting and stamping.

36. An in-line roller skate frame according to claim 25, wherein:

said reinforcement extends downwardly to a lower end, said lower end including said holes for attachment of rollers.

37. An in-line roller skate frame according to claim 36, wherein:

said holes in said lower end of said reinforcement are bored and threaded.

38. An in-line roller skate frame comprising:

a front foot-bearing portion and a rear foot-bearing portion, said front and rear foot-bearing portions being made unitarily;

lateral flanges spaced apart a distance to accommodate attachment of a plurality of in-line rollers, said lateral flanges extending downwardly from each of said front and rear foot-bearing portions, each of said lateral flanges comprising at least a base part and a reinforcement, each of said lateral flanges further comprising a respective recess in said base part, at least a part of each of said reinforcements being fastened within a respective one of said recesses, and said reinforcements of said lateral flanges being independent and non-unitary with respect to each other;

each of said reinforcements being made of a material having different mechanical characteristics relative to said base parts of said lateral flanges; and holes extending within said reinforcements for attachment of rollers.

39. A frame for a gliding sport article, said frame comprising:

a front foot-bearing portion and a rear foot-bearing portion, said front and rear foot-bearing portions being made unitarily;

transversely spaced apart lateral flanges extending downwardly from each of said front and rear foot-bearing portions, each of said lateral flanges comprising at least a base part and at least one of said lateral flanges further comprising a reinforcement, at least said one of said lateral flanges further comprising a recess with at least a part of said reinforcement being fastened within said recess; and said reinforcement being made of a material having different mechanical characteristics relative to said base parts of said lateral flanges, said reinforcement extending along substantially an entire length of the frame.

* * * * *